United States Patent [19]

Wilson

[11] Patent Number: 4,570,798

[45] Date of Patent: Feb. 18, 1986

[54] STACKABLE CONTAINER FOR USE IN BAKERY GOODS DISTRIBUTION SYSTEMS, AND THE LIKE

[76] Inventor: James D. Wilson, 421 Vista Suerte, Newport Beach, Calif. 92660

[21] Appl. No.: 686,440

[22] Filed: Dec. 26, 1984

[51] Int. Cl.[4] ..... B65D 21/04

[52] U.S. Cl. ..... 206/505

[58] Field of Search ..... 206/505, 506, 507

[56] References Cited

U.S. PATENT DOCUMENTS

| | | | |
|---|---|---|---|
| 3,404,804 | 10/1968 | Frater | 206/505 |
| 4,007,839 | 2/1977 | Stahl | 206/505 |
| 4,238,032 | 12/1980 | Thurman | 206/505 |
| 4,308,954 | 1/1982 | Wilson | 206/505 |
| 4,383,611 | 5/1983 | Kreeger | 206/505 |

*Primary Examiner*—George E. Lowrance

*Attorney, Agent, or Firm*—Keith D. Beecher

[57] ABSTRACT

A stackable container for transporting, storing and displaying bakery goods, and other products, and which may be stacked on top of like containers at different stacking levels for accommodating products of different heights, and to nest together when empty. The container includes sloping, stacking lugs and stacking feet, so that the container will slide into its properly aligned stacked position over a like container when stacked at various stacking levels over the lower container. The container is also constructed to be locked in place when stacked over a lower container to prevent it from becoming disengaged from the stack during transportation or rough handling.

9 Claims, 11 Drawing Figures

STACKABLE CONTAINER FOR USE IN BAKERY GOODS DISTRIBUTION SYSTEMS, AND THE LIKE

BACKGROUND OF THE INVENTION

The container of the present invention is of the same general type as the stackable containers described in U.S. Pat. Nos. 4,519,503 and 4,502,928 which issued May 28, 1985 and June 4, 1985, respectively in the name of the present inventor. The stackable containers described in the Copending Applications, and the stackable container of the present invention, may be loaded with bakery goods at the bakery and stacked on top of one another at upper intermediate stacking levels, depending upon the height of the goods, with the resulting stacks of containers being supported on appropriate dollies. The stacks of loaded containers may then be transported, for example, to the retail outlets. Upon arrival at the retail outlets, the stacks of containers may be rolled on the dollies to appropriate locations on the floor of the retail outlet. The products in the containers may then be displayed at the various locations in the retail outlet, and the products made available for purchase by customers while still in the containers. When the containers are empty, they may be stacked at a lower stacking level for space conservation purposes, and returned to the bakery.

The stackable container of the present invention constitutes an improvement over the stackable containers described in the Copending Applications, in that stacking of the individual containers into one another is facilitated by providing sloping stacking lugs and stacking feet, so that each container may conveniently slide to its appropriate stacked position over a like container in alignment with the latter container under the influence of gravity, and automatically to become locked in place.

Specifically, stackable containers, such as described in the Copending Applications, are difficult to stack by hand, or mechanically without complicated stacking and alignment equipment, because it is difficult to bring the containers into the required vertical alignment with one another after they have been stacked. This difficulty is overcome by the containers of the present invention by mounting the stacking lugs and feet in inclined positions, so that the only operation required to stack a container over a lower container is to place the container slightly forward of its static position on the lower container, and drop it into the lower container. The upper container will then slide by force of gravity and drop to its proper stacked position with the lower container in vertical alignment with the lower container. This feature facilitates manual stacking of the containers, and simplifies the equipment required mechanically to stack the containers.

Another problem encountered by these stackable containers of the Copending Applications is that they tend to be displaced from the stack during transportation by vibrations of the truck, or other carrier, or from rough handling. This causes the stacks to become unstable and to have a tendency to fall over. This latter problem is overcome by the containers of the invention by providing stacking lugs that cause the lower stacking feet of the upper container to lock under the stacking lugs of the lower container, for the upper stacking position of the containers; and by providing locking lugs, as will be described for locking the containers together for the intermediate and lower stacking positions. Thus, when containers of the present invention are stacked on top of one another, at any of several stacking levels, each container is firmly locked with the next lower container, assuring the stability of the stack.

Accordingly, the principal objectives of the present invention are to provide a container that may be stacked at different stacking levels over a like container without any requirement for difficult or awkward movements, such as tilting or rotation of the container, and which automatically becomes securely locked to the next lower container when it is in its stacked position, at any one of several stacking levels.

DETAILED DESCRIPTION OF THE ILLUSTRATED EMBODIMENT

Figures 1, 1A:
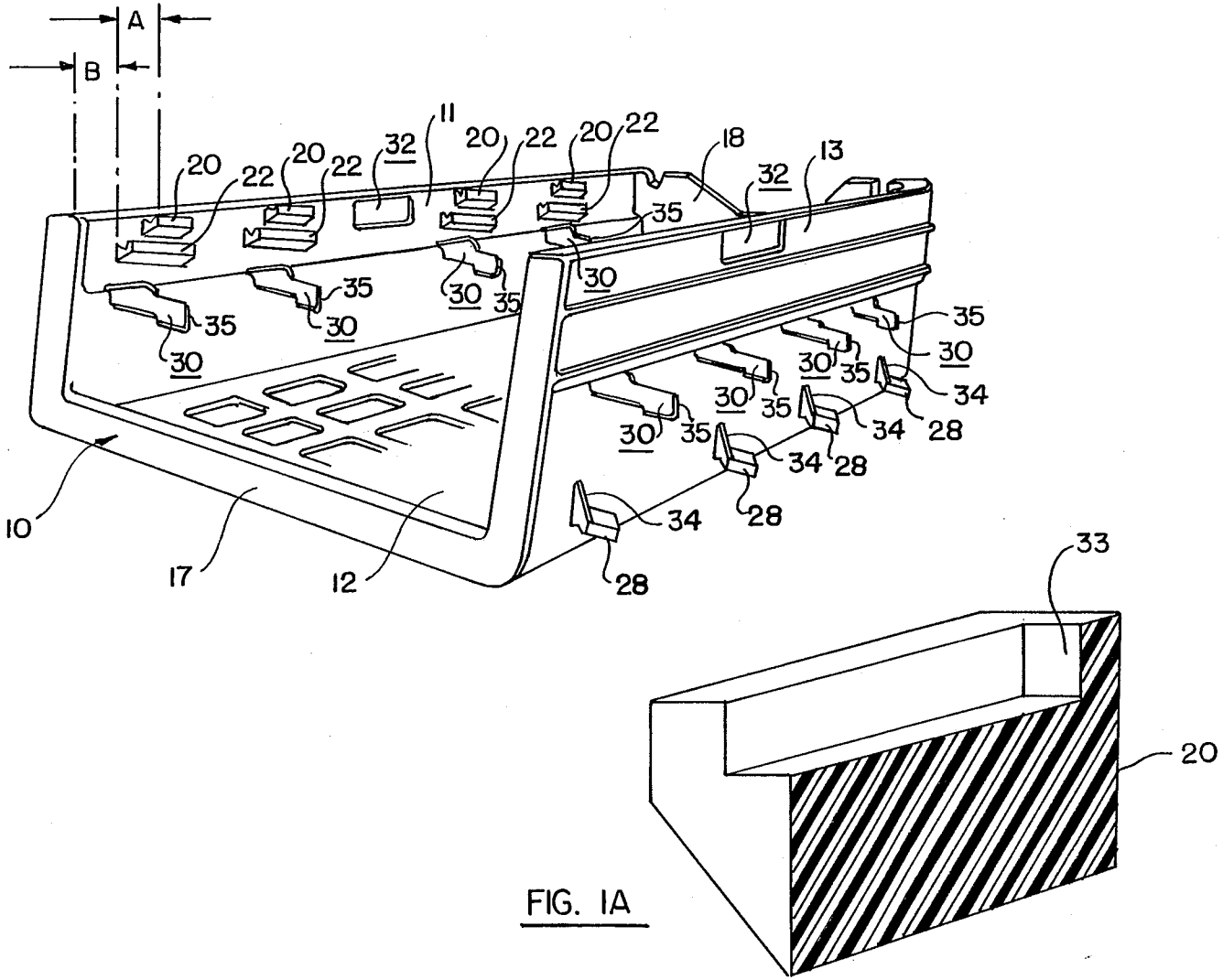
FIG. 1 is a perspective view of a stackable container representing one embodiment of the invention.
FIG. 1A is a fragmentary view of an upper stacking lug, a number of which are incorporated into the container of FIG. 1.

The container shown in FIG. 1 is designated 10, and it includes a bottom 12, side walls 11 and 13, a rear end wall 18, and a front wall 17 of a U-shape to provide an open front for the container. The container 10 may be stacked on a like container at three different stacking levels, designated an upper stacking level, an intermediate stacking level, and a lower stacking level. The front and rear walls 17 and 18 of the container are tilted inwardly to facilitate stacking of the container at the intermediate and lower stacking levels.

The container 10 may be molded as an integral unit and formed, for example, of an appropriate plastic material such as polypropylene, this being achieved by well-known injection molding techniques.

Each side of container shown in FIG. 1, is provided with four upper stacking lugs 20, and four intermediate stacking lugs 22, each of the stacking lugs being formed integral with the inner surfaces of the sides, and each of the stacking lugs being configured to slope down towards the rear wall 18 of the container, as shown.

Likewise, each side of the container 10 is equipped with four lower stacking feet, such as stacking feet 28, which likewise slope down towards the rear wall 18. The stacking feet 28 each has a shape such as shown in FIG. 1 and includes a gusset 34. As mentioned, the upper and intermediate stacking lugs 20 and 22 are formed on the inner surface of each of the side walls 11 and 13 of container 10, and the stacking feet 28 are formed on the outer surfaces of each of the side walls, as clearly shown in FIG. 1.

Each side wall 11 and 13 also contains a series of openings 30 positioned under corresponding pairs of stacking lugs 20, 22. As illustrated, each of the intermediate stacking lugs 22 projects beyond the forward end of the corresponding upper stacking lugs 20, and each of the openings 30 projects beyond the forward end of the corresponding intermediate stacking lugs 22. Each of the upper stacking lugs 20 has a configuration shown in FIG. 1A and includes an end wall 33 at the rear end of the stacking lug.

As mentioned above, container 10 of FIG. 1 may be stacked on other like containers at three stacking levels. For example, in the upper stacking level, the stacking feet 28 of container 10 are supported by the upper stacking lugs 20 of a similar lower container. During the stacking operation, the upper container is placed on the lower container displaced slightly forward from the lower container. Then, due to the sloping configuration of the feet 28 and lugs 20, the upper container is moved by gravity into an aligned position over the lower container, when it is released, as the stacking feet 28 of the upper container move against the end walls 33 of the upper stacking lugs 20 of the lower container. The upper container is then held in vertical alignment with respect to the lower container by the end walls 33 of lugs 22 which act as stops for feet 28 of the upper container. The upper container is now stacked on the lower container at the uppermost stacking level.

To lower the upper container down to the next stacking level over the lower container, the upper container is pulled forward so that its feet 28 may be pulled clear of the forward or open ends of the upper stacking lugs 20. The upper container is then allowed to drop so that its feet 22 drop down from the upper stacking lugs 20 to the intermediate stacking lugs 22. The upper container then slides back under the influence of gravity until the gussets 34 of the stacking feet of the upper container contact the upper stacking lugs 20 of the lower container and the upper container is then held in vertical alignment with respect to the lower container.

To position the container 10 of FIG. 1 into the lower container at the lowermost stacking position, the upper container is then pulled towards the open front of the lower container until its feet 28 clear the forward ends of the intermediate stacking lugs 22 of the lower container. The upper container is then allowed to drop into the lower container with its feet 28 being received in the openings 30 of the lower container. Again, the upper container slides back into the lower container under the force of gravity, until its feet 28 are stopped by the rear edges 35 of opening 30 of the lower container, and the upper container is thus held in vertical alignment with respect to the lower container.

In the manner described above, and due to the sloping configuration of lugs 20 and 22, and stacking feet 28, the upper container at each stacking level is firmly supported over the lower container due to the forces of gravity which cause the upper container to move back until it is stopped by the elements described above.

Briefly stated, any container 10 may be stacked on a lower like container by displacing it generally in a horizontal position above the lower container so that its feet 28 are either directly above lugs 20 of the lower container for stacking in the upper stacking level; or above lugs 22 in space "A" for stacking in the intermediate position; or above the upper end of openings 30 of the lower container in space "b" for stacking in the lower position, and then by lowering the upper container until its feet 28 engage the corresponding lugs or openings of the lower container, and then allowing gravity to move the upper container towards the end wall 18 of the lower container until it is properly aligned over the lower container. In most of the larger bakeries, the foregoing operations would be carried out with automatic stacking devices or robots. As mentioned above, the construction of the container of the invention simplifies the design of the stacking equipment or robots, since the latter are required merely to set the upper container at a particular position over the lower container, and then to release the upper container allowing it to drop, and then slide back to its proper aligned position over the lower container.

Figure 3:
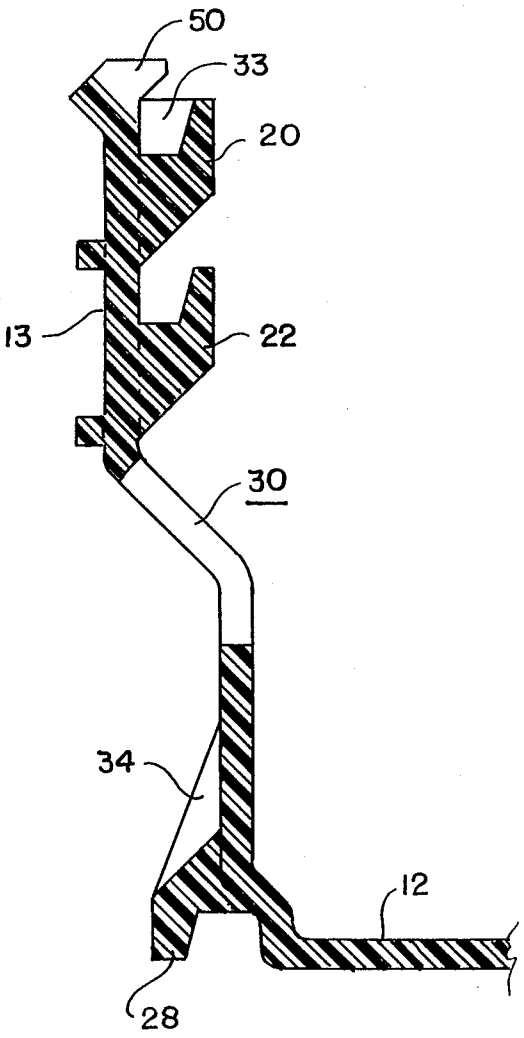
FIG. 3 is a sectional view of the container of FIG. 2 taken essentially along the line 3—3 of FIG. 2.
Figure 2:
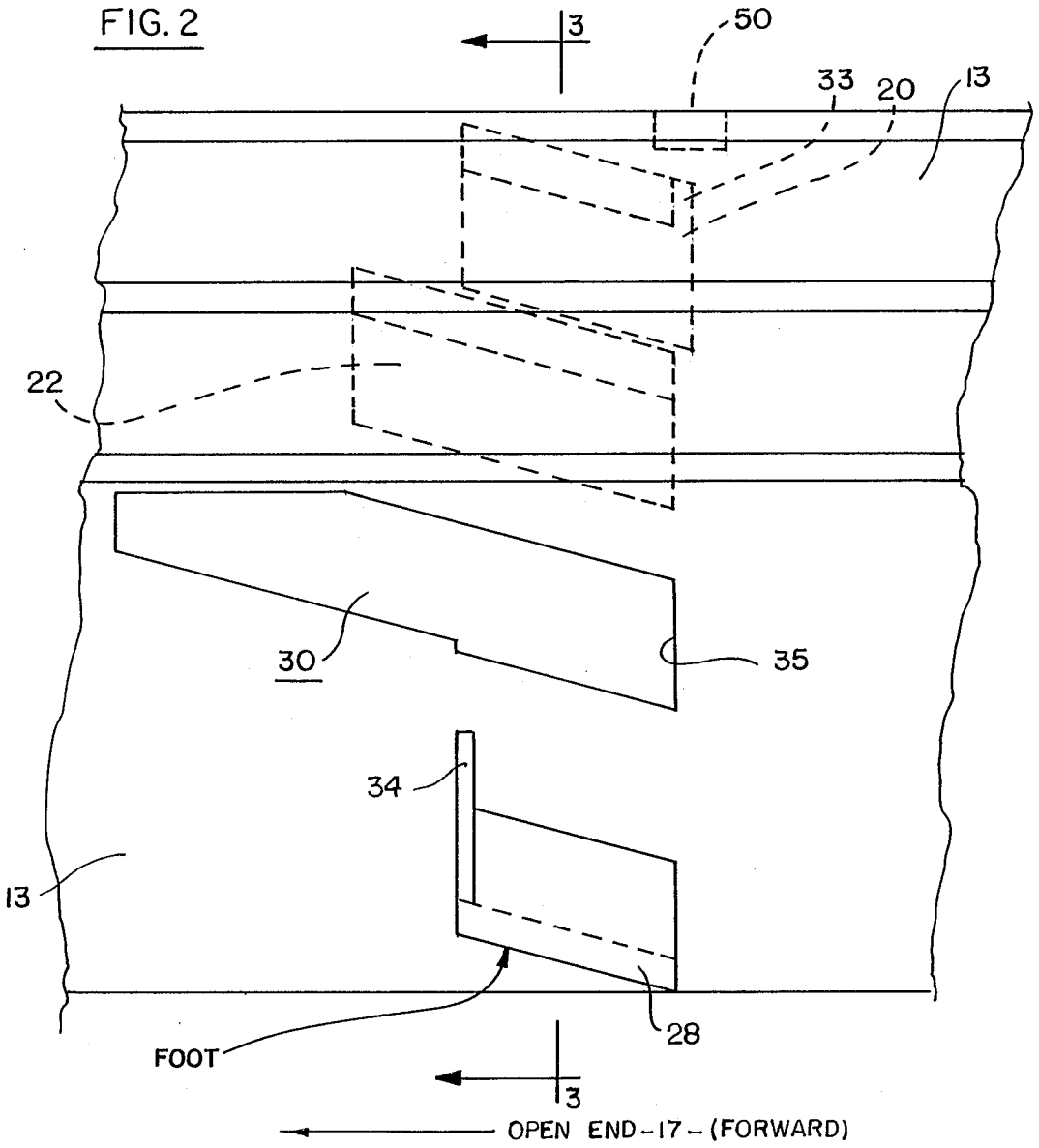
FIG. 2 is a fragmentary side elevational view of the container of FIG. 1.

The fragmentary side elevational view of FIG. 2, and the sectional view of FIG. 3, shows the location and configuration of one of the sets of upper stacking lugs 20, intermediate stacking lugs 22, opening 30, and lower stacking feet 28.

Figure 5:
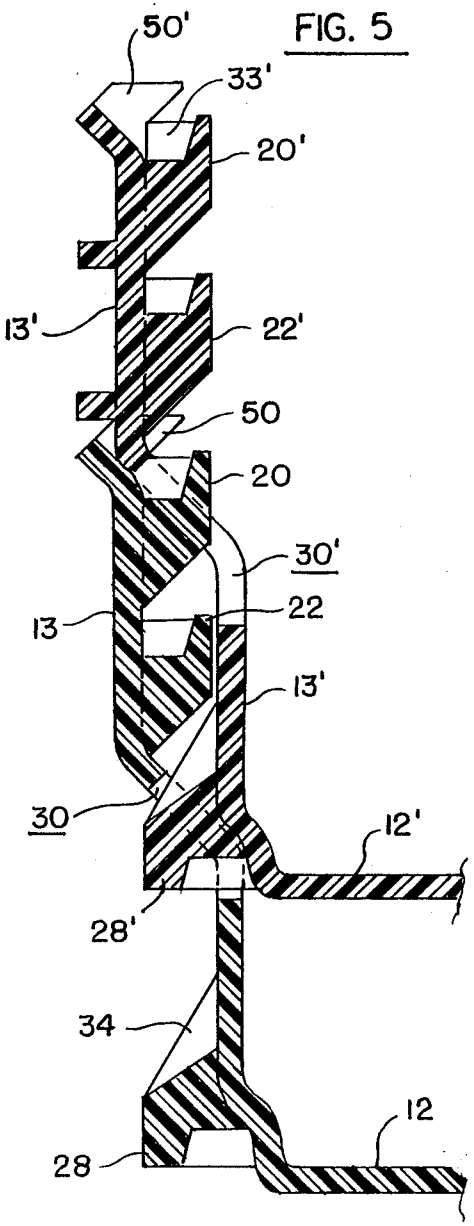
FIG. 5 is a sectional view, taken essentially along the line 5—5 of FIG. 4, showing the manner in which the two containers of FIG. 4 are stacked on one another.
Figure 4:
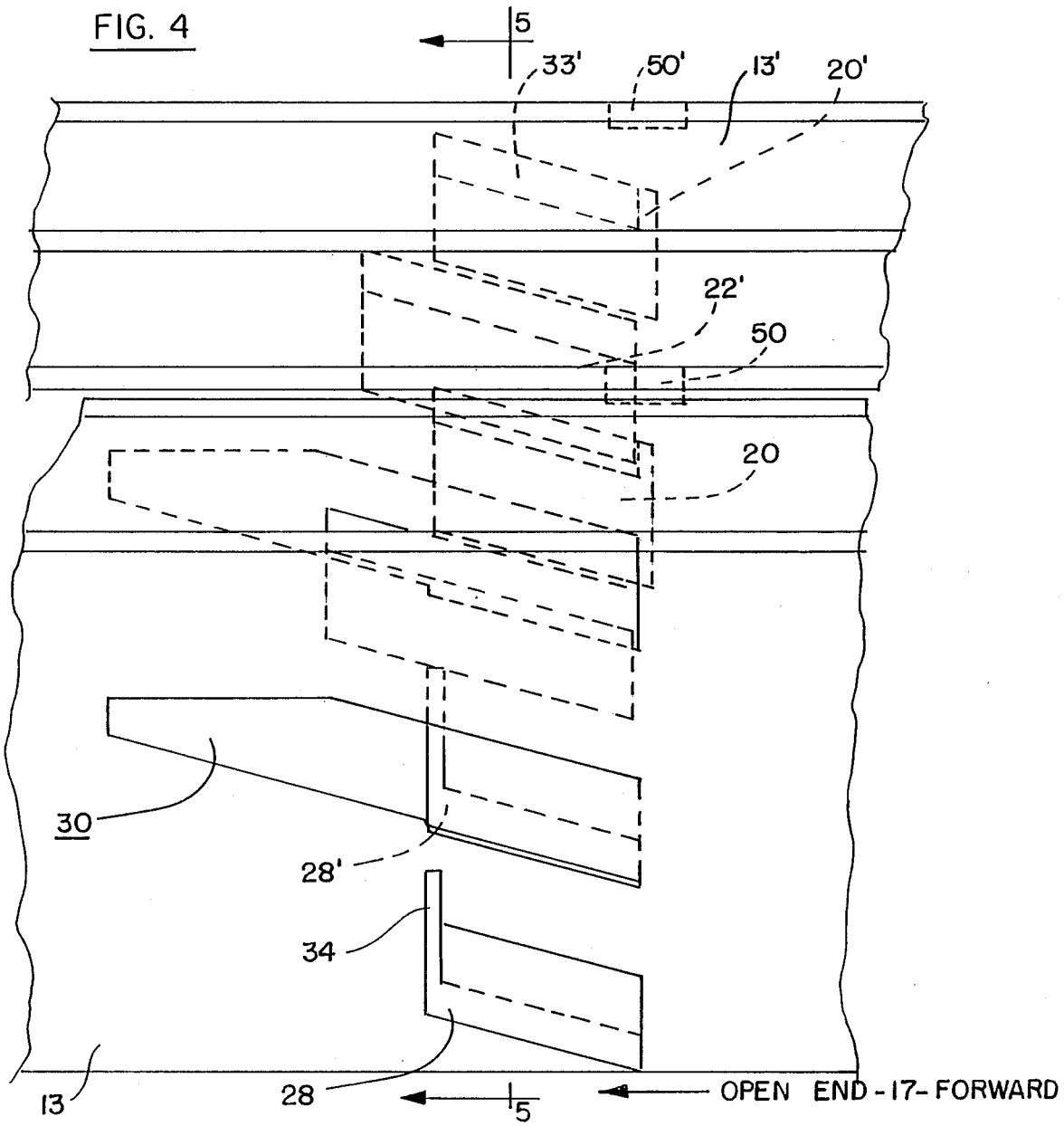
FIG. 4 is a fragmentary side elevational view of the container of FIG. 1, with a second like container stacked on top of it in the lowermost stacking position.

The fragmentary view of FIG. 4, and sectional view of FIG. 5, shows the manner in which an upper container may be stacked at the lowermost stacking position over a lower like container. In the representation of FIG. 4, the elements of the upper container corresponding to the elements of the lower container are designated by the same numbers as the lower container, but primed.

Figure 7:
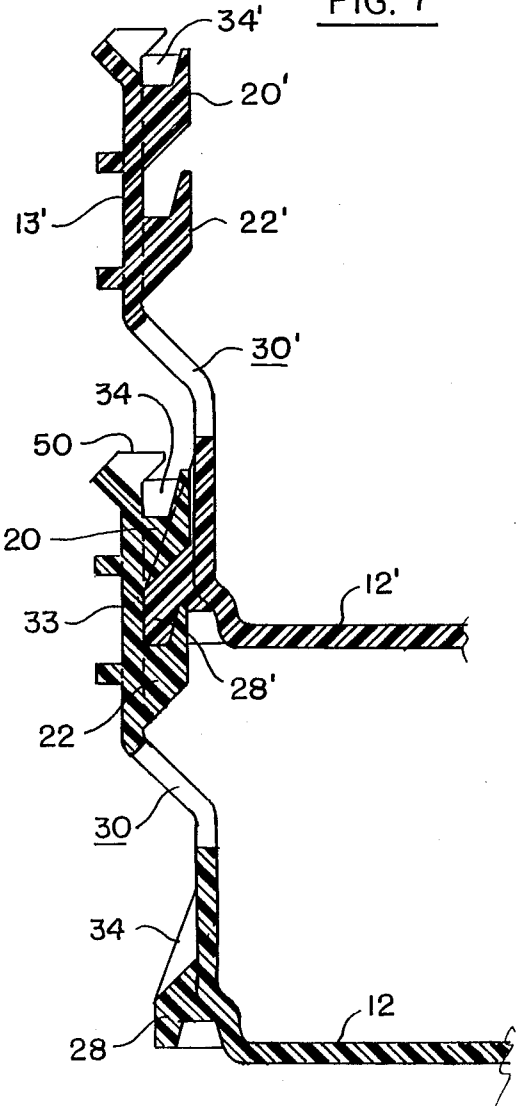
FIG. 7 is a sectional view of the container of FIG. 1, showing the manner in which the upper container is stacked on the lower container.
Figure 6:
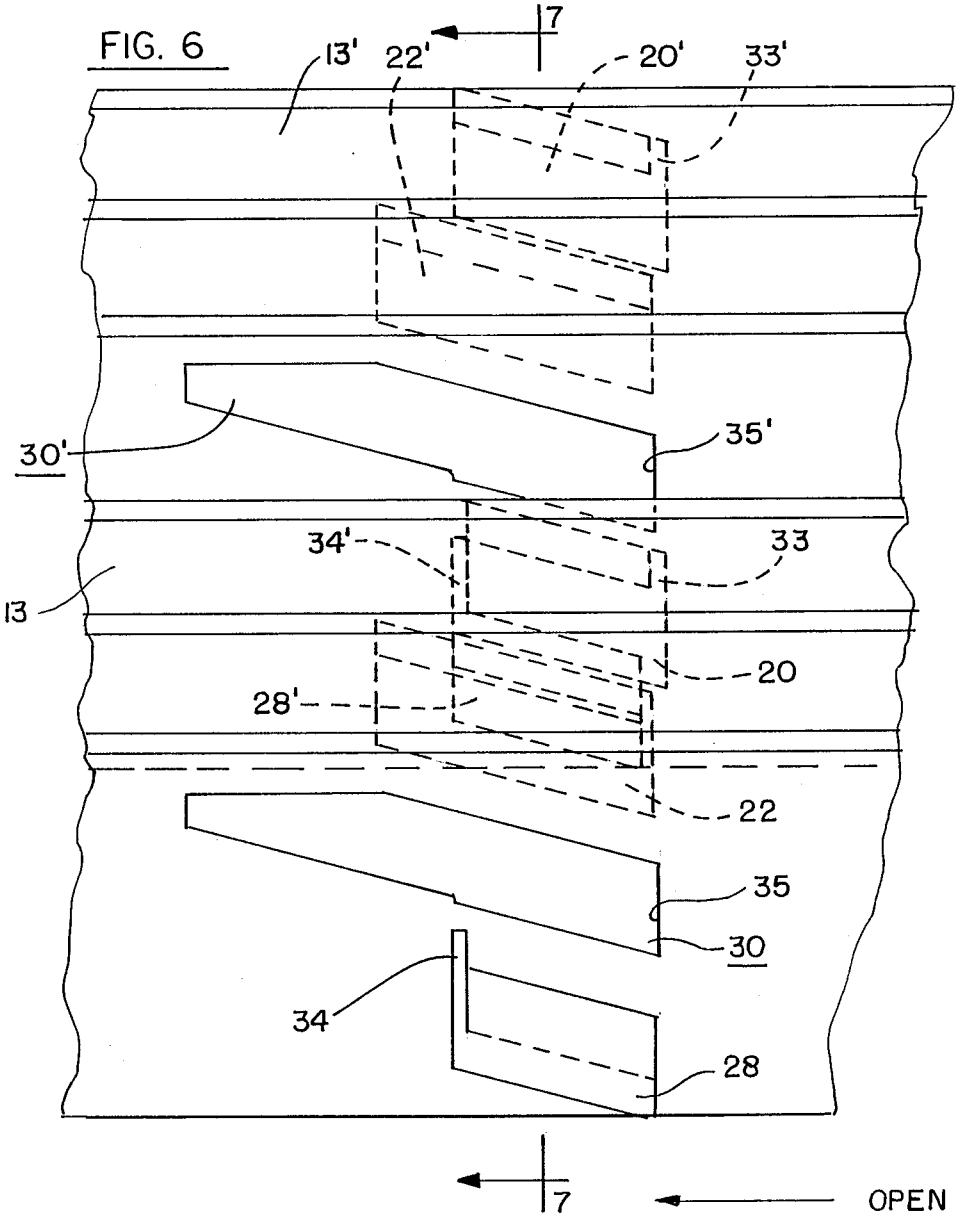
FIG. 6 is a fragmentary side elevational view of the container of FIG. 1, with a second container stacked on it at an intermediate stacking level.

Likewise, the fragmentary elevational view of FIG. 6, and the corresponding sectional view of FIG. 7, shows the manner in which the upper container may be stacked on the lower container at the intermediate position.

Figure 9:
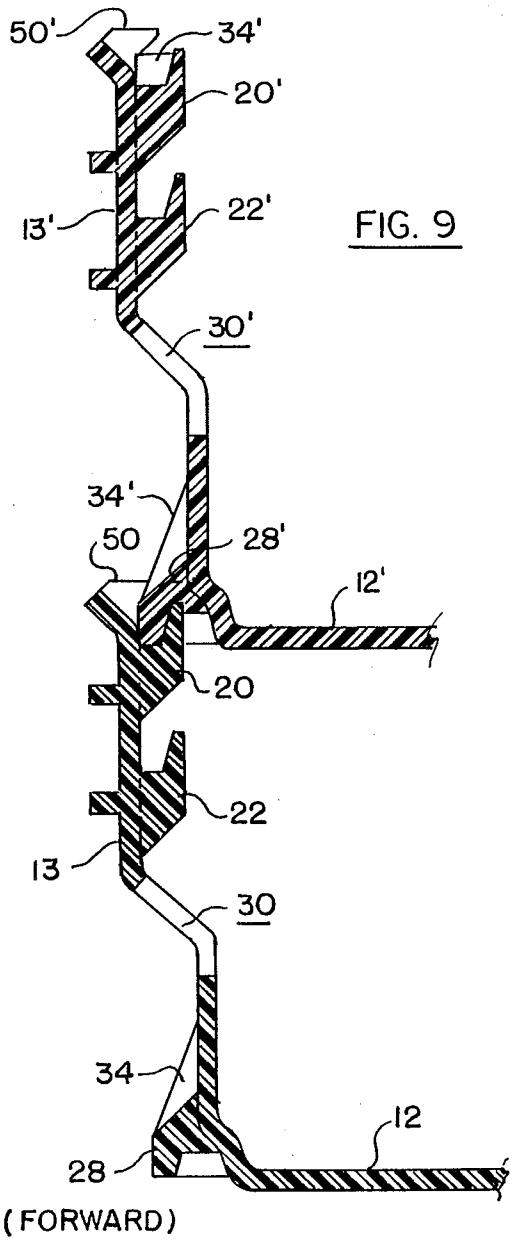
FIG. 9 is a sectional view, taken along the line 9—9 of FIG. 8, and showing the manner in which the upper container is stacked on the lower container at the uppermost stacking level.
Figure 8:
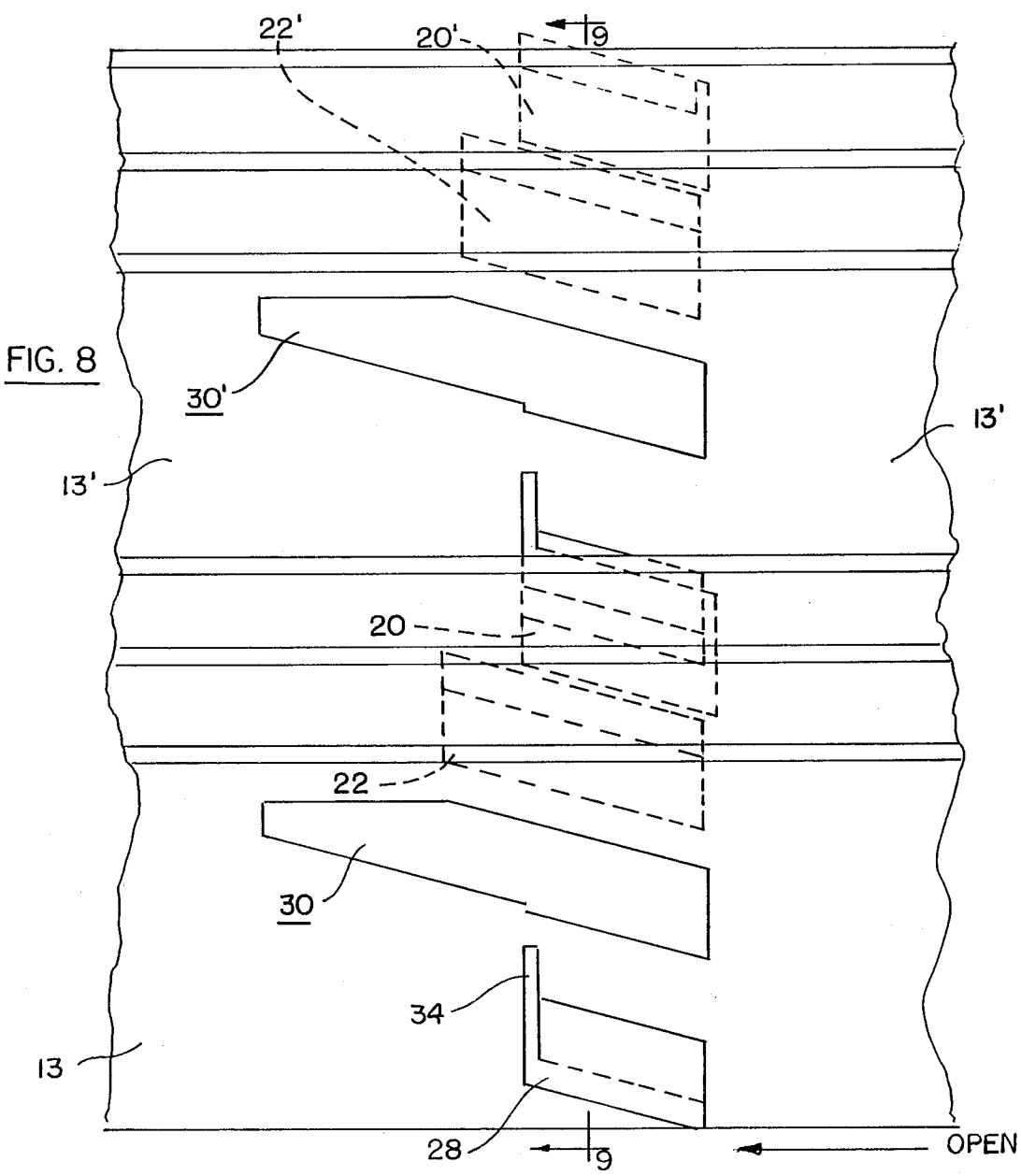
FIG. 8 is a fragmentary side elevational view of the container of FIG. 1, with a second container stacked on it at the uppermost stacking level.

It should be noted in the views of FIGS. 2–5, that the containers are provided with lugs 50 which are positioned over each of the upper stacking lugs 20. Then, when the containers are stacked on one another at the uppermost stacking level, as shown in FIGS. 8 and 9, the stacking feet 28' of the upper container slide into the upper stacking lugs 20, and under the lugs 50. The lugs 50 then serve to prevent the upper container from being shaken loose from the lower container, and effectively serve to lock the upper container onto the lower container. The only way in which the upper container can be released from the lower container is to slide it forwardly towards the forward end of the lower container, until the upper stacking lugs 20 clear the lugs 50.

When the containers are stacked in their lowermost stacking level, as shown in FIGS. 4 and 5, the stacking feet 28' of the upper containers slide under the intermediate stacking lugs 22 to hold the containers locked on one another when stacked in that position.

Finally, in the intermediate stacking position of FIGS. 6 and 7, the stacking feet 28' of the upper stacking container is locked by the upper stacking lugs 20 of the lower stacking container. Accordingly, in each stacking position, the upper container is securely locked onto the lower container to obviate any tendency for the containers to be separated from one another during transportation or rough handling.

Figure 10:
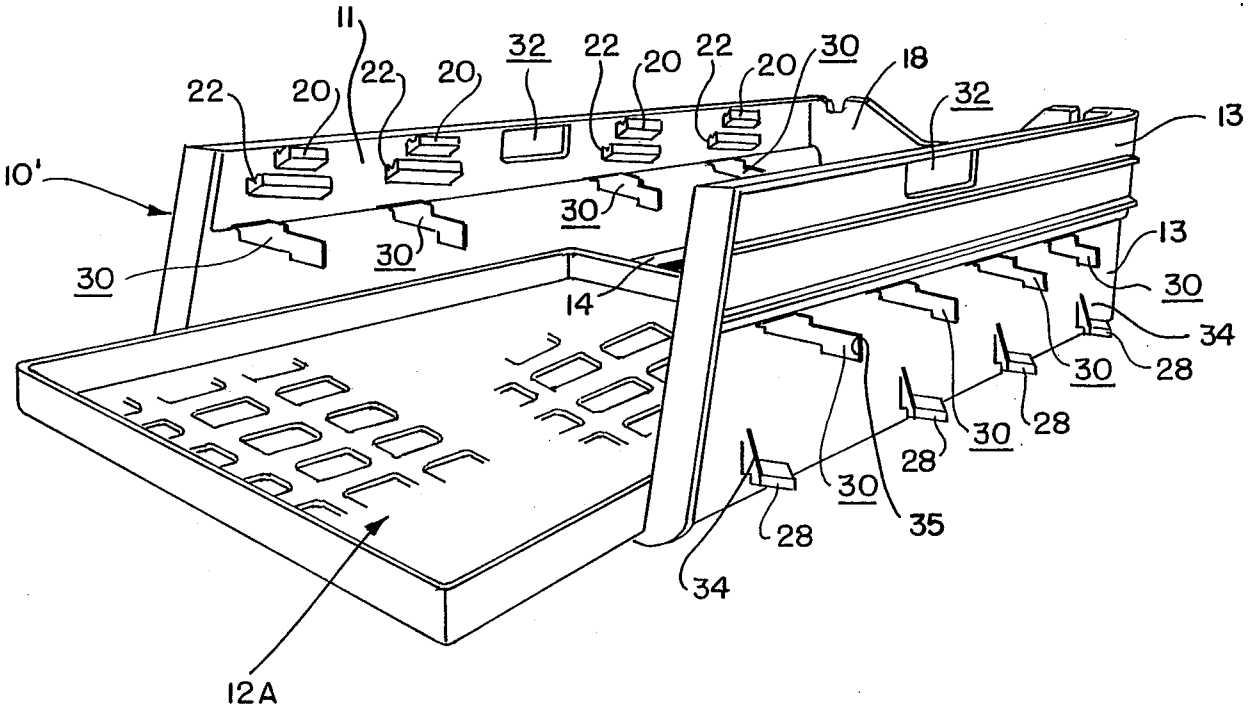
FIG. 10 is a perspective view of a stackable container representing a second embodiment of the invention.

The container shown in FIG. 10 is generally similar to the container of FIG. 1, except that, instead of being provided with a bottom 12, as is the case with the container of FIG. 1, the 10' of FIG. 10 is provided with a tray 12A, which slides into place along flanges 14 to serve as a bottom for the container in the manner described in detail in Copending U.S. Pat. No. 4,519,503. The tray 12A is slidable out of the open front of the container for replacement or replenishment of the goods, or it may be loaded alone onto route trucks equipped with rails for supporting the trays, as also described in detail in the Copending U.S. Pat. No. 4,519,503.

The invention provides, therefore, an improved stackable container which may conveniently be stacked over like containers at a variety of stacking levels, with the force of gravity being utilized to facilitate the stacking of the containers onto one another in properly aligned positions, with means being provided to hold the containers in a stable stacked condition at any of the stacking levels.

It will be appreciated that while particular embodiments of the invention have been shown and described, modifications may be made. It is intended in the claims to cover all modifications which come within the spirit and scope of the invention.

I claim:

1. A stackable container formed of molded plastic material constucted to be stacked on other like containers at different stacking positions, said container having first and second side walls, an open front and a rear wall, each of said side walls having a plurality of discrete integral upper stacking lugs formed on the inner surface thereof at spaced positions along the upper edge thereof from the front to the rear of the container, with each of said upper stacking lugs being formed to slope towards the rear wall of the container, and each of said side walls having a plurality of discrete integral lower stacking feed formed on the outer surface thereof at spaced positions along the lower edge thereof, the lower stacking fee being positioned to be received on the upper stacking lugs of a like container, and the lower stacking feet likewise being formed to slope towards the rear wall of the container, so that the first-named container moves under the force of gravity towards the rear wall of the like container when the first-named container is stacked on the upper stacking lugs of the like container.

2. The stackable container defined in claim 1, in which each of said side walls has a plurality of further discrete intermediate integral stacking lugs formed on the inner surface thereof under respective ones of the upper stacking lugs and extending beyond the respective forward ends of the corresponding upper stacking lugs by a predetermined amount, and said intermediate stacking lugs likewise being formed to be sloping toward the rear wall of the container, so that the first-named container moves under the force of gravity towards the rear wall of the like container when the first-named container is stacked on the intermediate stacking lugs of the like container.

3. The stackable container defined in claim 2, in which each of the sides includes openings positioned below respective ones of the intermediate stacking lugs to permit the first-named container to be stacked of the like container at a lower stacking position with the lower stacking feet of the first-named container being received in respective ones of the openings of the like container, and with each opening extending beyond the forward edge of the corresponding intermediate stacking lug, and with each opening sloping toward the rear wall of the container, so that the first-named container moves under the force of gravity toward the rear wall of the lower container when the first-named container is stacked in the lower stacking position on the like container.

4. The stackable container defined in claim 1, in which at least one of the upper stacking lugs includes an end wall to engage the corresponding lower stacking foot of the first-named container to limit movement of the first-named container towards the rear wall of the like container and establish the containers in vertical alignment.

5. The stackable container defined in claim 2, in which at least one of the lower stacking feet includes a gusset to engage a corresponding upper stacking lug of the like container when the first-named container is stacked on the intermediate stacking lugs of the like container to limit movement of the first-named container towards the rear wall of the like container and establish the containers in vertical alignment.

6. The stackable container defined in claim 3, in which at least one of said openings has a rear edge to be engaged by a corresponding lower stacking foot of the first-named container when the first-named container is stacked on the like container at the lower stacking position to limit movement of the first-named container towards the rear wall of the like container and to establish the containers in vertical alignment.

7. The stackable container defined in claim 1, in which the container includes at least one lug formed on the top edge of at least one of the side walls thereof over a corresponding upper stacking lug to lock the first-named container to the like container when the first-named container is stacked on the upper stacking lugs of the like container.

8. The stackable container defined in claim 2, in which the upper stacking lugs are positioned relative to the intermediate stacking lugs to engage the tops of the lower stacking feet to lock the first-named container on the like container when the first-named container is stacked on the intermediate stacking lugs of the like container.

9. The stackable container defined in claim 3, in which the intermediate stacking lugs are positioned relative to the openings to engage the top of the first-named stacking feet of the upper container to lock the first-named container on the like container when the first-named container is stacked in the lower stacking position on the like container.

* * * * *